United States Patent [19]

Phillips

[11] Patent Number: 4,532,489

[45] Date of Patent: Jul. 30, 1985

[54] FUSES, PARTICULARLY SUBMINIATURE CARTRIDGE FUSES, AND A METHOD OF MANUFACTURE THEREOF

[75] Inventor: John P. Phillips, Bath, England

[73] Assignee: Dubilier PLC, Abingdon, England

[21] Appl. No.: 596,872

[22] Filed: Apr. 5, 1984

[30] Foreign Application Priority Data

Apr. 8, 1983 [GB] United Kingdom ..... 8309642

[51] Int. Cl.[3] ..... H01H 85/14

[52] U.S. Cl. ..... 337/228; 337/252; 29/623

[58] Field of Search ..... 337/231, 232, 237, 248, 337/251, 252, 253, 254, 227, 228, 166; 29/623

[56] References Cited

U.S. PATENT DOCUMENTS 3,304,394 2/1967 Urani ..... 337/252

FOREIGN PATENT DOCUMENTS 2079550A 1/1982 United Kingdom .

*Primary Examiner*—Harold Broome

*Attorney, Agent, or Firm*—Biebel, French & Nauman

[57] ABSTRACT

A subminiature fuse comprises a fuse element (1) disposed within a glass sleeve (2) and connected at opposite ends to tail wires (3) which are formed with collars (4) fusion bonded to the wires (3). The collars are positioned within opposite ends of the sleeve (2) which are fused about the collars (4) to effect hermetic sealing. The collars may be glass beads disposed about the wires (4) or they may be of metal suitably having a coefficient of expansion matching that of the glass sleeve (2).

10 Claims, 6 Drawing Figures

FUSES, PARTICULARLY SUBMINIATURE CARTRIDGE FUSES, AND A METHOD OF MANUFACTURE THEREOF

This invention relates to fuses and a method of manufacture of fuses and is particularly concerned with subminiature cartridge fuse links which may, for example, comprise an hermetically sealed fuse link comprising a sealed package of length of about 5 mm with tail wires extending from opposite ends of the package for connection of the fuse link in to electrical circuitry.

BACKGROUND OF THE INVENTION

Subminiature fuse links are known which comprise a glass insulating body or barrel containing a fusible element with tail wires extending from opposite ends of the barrel, which ends fusibly deformed about and hermetically sealed to the tail wires. It is also known to enclose such fuse links within an insulating sleeve or coating of an insulating cement further to strengthen and insulate the assembly, the tail wires projecting from the insulating sleeve or coating for connection to circuitry terminals by soldering or other known means.

It is also known to provide a subminiature fuse link which comprises a fusible wire element arranged diagonally across a tubular glass body, ends of the link being folded back externally of the sleeve and secured by metal end caps fitted over the ends of the sleeve and containing a solder coating fused to connect the fusible link to the caps and secure the caps to the sleeve. Each end cap additionally has a tail wire projecting therefrom. In use of such a fuse link there is risk that soldering of the tail wires to circuitry may by heat conduction cause flow of the solder in the end caps and destruction or alteration of the characteristics of the fuse.

It is an object to provide a fuse link of simple construction and method of manufacture.

SUMMARY OF INVENTION

A method of manufacturing a cartridge fuse link of the kind comprising a glass sleeve containing a fuse element connected at opposite ends to tail wires extending from respective ends of the sleeve which are hermetically sealed about the tail wires characterised by forming the tail wires with annular collars to fit within respective ends of the sleeve and fusing the ends of the sleeve about the collar to secure the sleeve to the collar in an hermetic seal.

The collar may comprise glass beads fused about the tail wires or they may comprise metal collars integrally formed with or sealingly secured to the lead wires. Alternatively the collar may be formed as a cylindrical member formed at one side with a spigot connected to the fusible link and at the other side connected for example by welding to a tail wire.

A cartridge fuse link according to the invention of the kind comprising a glass sleeve containing a fuse element connected at opposite ends to tail wires extending from respective ends of the sleeve which are hermetically sealed about the tail wires is characterised by annular collars formed about the tail wires and fitted within opposite ends of the sleeve, the sleeve ends being fused about the collar in hermetically sealed engagement therewith.

In one embodiment the collar comprises respective glass beads disposed about the tail wires and fused into hermetically sealed engagement therewith. In another embodiment each tail wire is formed or provided with a metal collar which may, for example be formed by upsetting the metal of the tail wire or be formed as a sleeve fitted over the tail wire and welded or soldered thereto. In a further embodiment the collar is formed as a metal cylindrical member with a spigot at one side connected to the fuselink and at the other secured to a tail wire suitably by welding.

Suitably the metal collar is of nickel-iron alloy with a coefficient of expansion matching that of the glass of the sleeve. A suitable alloy has been found to be a 42% Ni 58% Fe alloy copper clad 23/27% by volume and sold under the Trade Mark DUMET.

The collar may be formed with a spigot at opposite sides to facilitate welding of the tail wire thereto.

The fuse link may be arranged to extend in rectilinear fashion between the tail wires and through the sleeve. Alternatively it may be arranged diagonally, generally between opposite sides of the sleeve, with end portions folded in generally Z-fashion to extend transversely across the tail wires or spigots of the end collar. This facilitates welding of the fuse link to the tail wires or spigots.

The envelope provided by the glass sleeve may contain matter, e.g. a gas to modify the characteriistics of the fuse link. For example the envelope may contain carbon dioxide to act as an arc quenching mechanism or it may contain oxygen to accelerate oxidisation on fusing.

In order to protect the cartridge fuses the glass sleeve may be encased within an insulating sleeve or it may be coated by dipping with an insulating cement.

BRIEF DESCRIPTION OF THE DRAWINGS

The invention will now be described, by way of example, with reference to the accompanying partly diagrammatic drawings, in which.

DETAIL DESCRIPTION OF THE DRAWINGS

Figure 1:
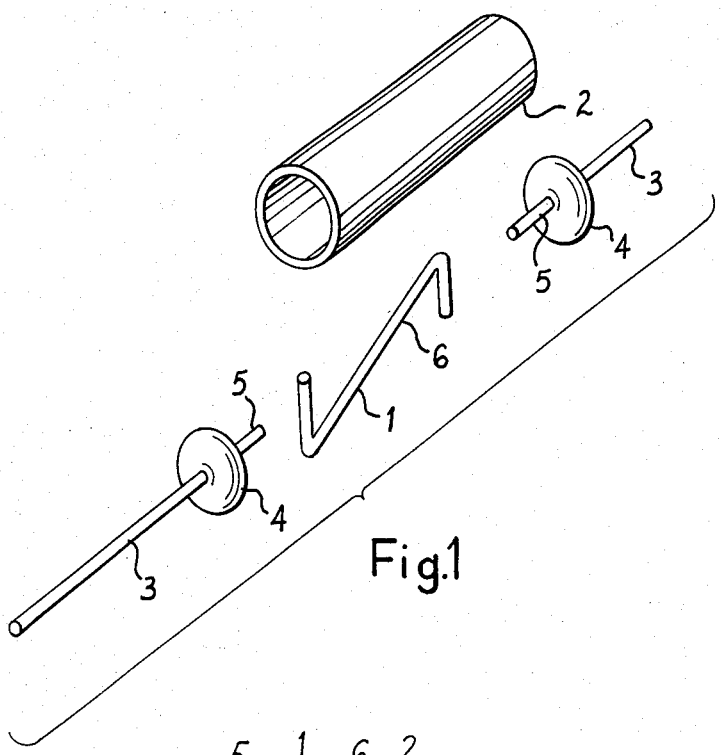
FIG. 1 is an exploded perspective view of a subminiature cartridge fuse link according to one embodiment.
Figure 2:
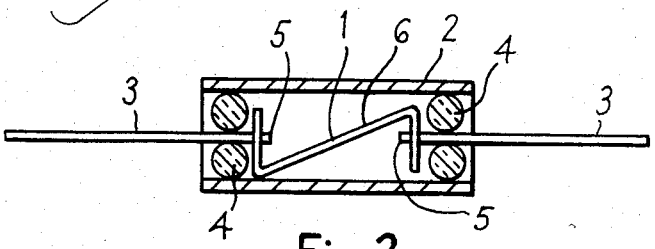
FIG. 2 is a sectional side elevation of the fuse of FIG. 1 in assembled condition but prior to sealing.
Figure 3:
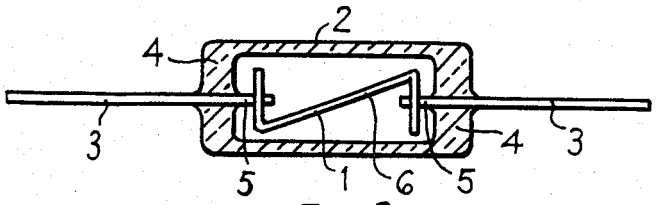
FIG. 3 is a view corresponding to FIG. 2 but after sealing.

The embodiment of FIGS. 1 to 3 comprises a Z-shaped fusible wire element 1, a glass sleeve 2 of tubular form, a pair of tail wires 3 each provided with an annular glass bead 4 lightly fused to the associated tail wire which projects beyond the bead 4 on opposite sides. The beads 4 define annular collars on the tail wires and are adapted to fit within opposite ends of the sleeve 2, as seen in FIG. 2, with short lengths 5 of the tail wires projecting within the sleeve 2 and long tails extending generally axially away from the sleeve 2 at opposite ends.

The fuse is assembled by connecting respective end links of the Z-shaped wire element 1 to respective tail wire portions 5, the end limbs being arranged transversely so that a main portion 6 of the element 1 extends diagonally when assembled into the sleeve 2. The end limbs of the element 1 are suitably secured electrically and mechanically to the respective short lengths 5 of tail wires 3 by fusion bonding or welding, and the element 1 is then positioned within the sleeve 2 with the glass beads 4 slidably disposed in opposite ends of the sleeve 2. The sleeve ends are then heated to fuse them about the beads 4 and effect fusion bonds and hermetic seals at opposite ends of the sleeve.

The fusion heat applied to the sleeve ends is suitably arranged to fuse the beads 4 more closely about the tail wires 3, as shown in FIG. 3.

In order to regulate the fuse characteristics the sleeve 2 may be filled with a gaseous medium during assembly of the fuse element 1 and prior to fusion of the sleeve end portions. For example carbon dioxide may be employed to act as an arc quenching medium or oxygen may be employed to accelerate oxidisation of the element 1 on fusing in use.

The tail wires are, for example, of tinned copper wire, and the fuse element is of suitable metal or alloy having desirable fuse characteristics. Although the embodiment has been described using a fuse element formed separately and then welded to the tail wires 3 at opposite ends, it is to be understood that the fuse element may be formed integrally with the tail wires from a single length of wire having a central fusible section defined by a reduced thickness portion formed by mechanical or chemical processing.

Figure 4:
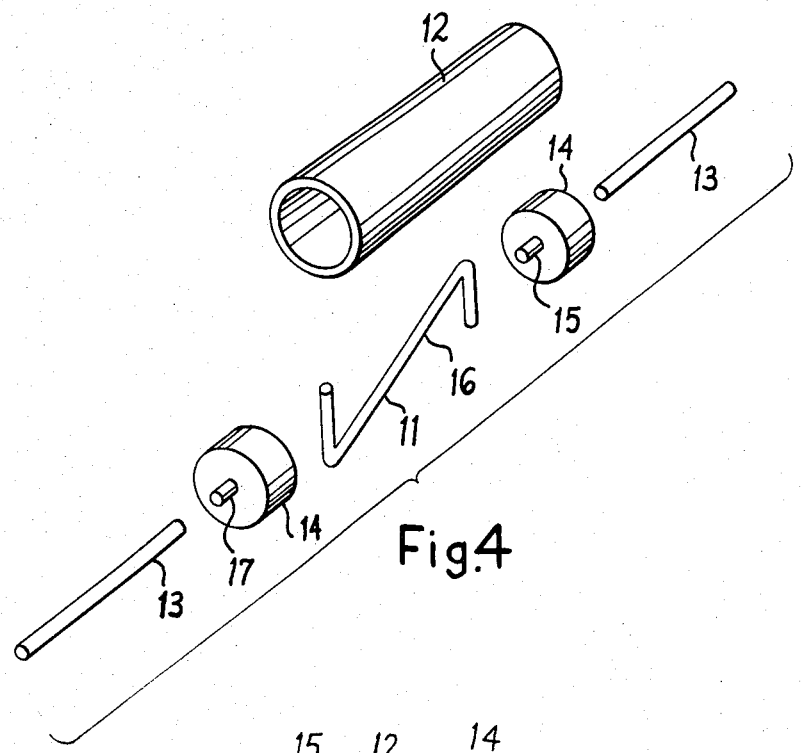
FIG. 4 is an exploded perspective view of a further embodiment.
Figure 5:
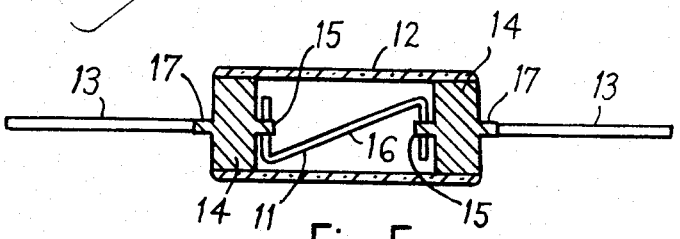
FIG. 5 is a sectional side elevation of the fuse of FIG. 4 in assembled condition.

Referring now to FIGS. 4 and 5 the fuse embodiment comprises a glass sleeve or barrel 12 of tubular form, a fuse element 11,16 corresponding to that of the embodiment of FIGS. 1 to 3, and a pair of metallic end members 14 of solid cylindrical form and having short axial spigots 15, 17 at opposite sides. The member 14 of cylindrical portion between the spigots 15, 17 are adapted to fit within opposite ends of the sleeve 12, as seen in FIG. 5. The fuse is assembled by fusion bonding or welding the end limbs of the element 11 to respective inner spigots 15 of the end member, the end limbs suitably being arranged transversely of the spigots 15 so that the main limb 16 extends diagonally. Ends of the tail wires 13 are welded to respective outer spigots 17, and the fuse element 11 is assembled into the sleeve 12 with the end member 14, which define collars on the tail wires, slidably disposed within respective ends of the sleeve 12. The ends of the sleeve are then subject to fusion heat to fuse the ends about the end member 14 and effect hermetic seals thereto at opposite ends of the tube.

The end members are suitably made from metal or alloy having a coefficient of expansion closely matching that of the glass of the sleeve 12, for example a nickel-iron alloy. An alloy of 42% nickel and 58% iron, copper clad 23/27% by volume (Trade Name DUMET) has been found to be particularly suitable.

Figure 6:
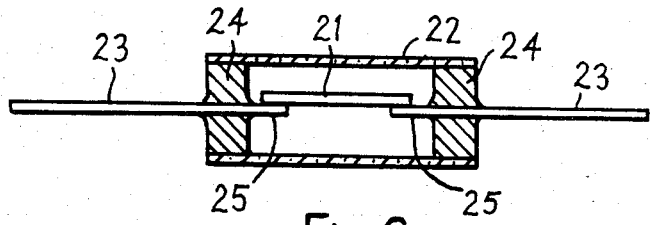
FIG. 6 is a sectional side elevation of an alternative construction of subminiature cartridge fuse link.

In the embodiment of FIG. 6 a straight fuse element 21 is employed, the element being shorter than a surrounding glass sleeve or barrel 22. Tail wires 23 extend through bores in respective end members 24 which define collars: on the tail wires, and which are fitted within respective ends of the sleeve 22. Short lengths 25 of the tail wires project inwardly of the sleeve 22 and are lapped by respective ends of the fuse element 21 and are fusion bonded or welded thereto. The end members 24 are fusion bonded or welded about the tail wires in sealing engagement therewith, and opposite ends of the sleeve 22 are fused about respective members 24 to effect hermetic seals at the opposite ends of the sleeve 22.

In order further to protect fuses constructed according to the embodiments of FIGS. 1 to 6, the sleeves 2, 12 and 22 may be mounted within further insulating sleeves which may for example, be shrunk or fused down about opposite ends, but with the tail wires 3, 13, 23 extending therefrom. Alternatively the sleeves may be dipped in an insulating cement to form a coating encasing the fuse and adjacent portions of the tail wires.

Whilst particular embodiments have been described it will be understood that modifications can be made without department from the scope of the invention.

I claim:

1. A method of manufacturing a cartridge fuse link of the kind comprising a glass sleeve containing a fuse element connected at opposite ends to tail wires extending from respective ends of the sleeve which are hermetically sealed about the tail wires comprising the steps forming the tail wires with unitary annular collars to fit within respective ends of the sleeve, connecting the tail wires to opposite ends of the fuse element and entirely disposed between the collars, disposing the fuse element entirely within the sleeve with collars fitting within opposite ends thereof, and fusing the ends of the sleeve about the collars to secure the sleeve to the collars in an hermetic seal.

2. A method as claimed in claim 1, in which the collars are formed by glass beads disposed about and fusion bonded to respective tail wires and the fusion heat for fusing the sleeve to the collar is arranged to fuse the beads.

3. A method as claimed in claim 1, in which the collars are of metal fusion bonded to respective tail wires.

4. A method as claimed in claim 3, in which the metal of the collars is a nickel iron alloy having a coefficient of expansion matching that of the glass of the sleeve.

5. A method as claimed in claim 3, in which each metal collars comprises a solid cylindrical body adapted to fit within an end of the sleeve and formed at opposite sides with spigots to respective ones of which an end portion of a tail wire and an end portion of the fuse element are fusion bonded.

6. A cartridge fuse link comprising a glass sleeve containing a fuse element connected at opposite ends to tail wires extending from respective ends of the sleeve which are hermetically sealed about the tail wires, in which the tai1 wires are fusion bonded to respective unitary annular collars which are fusion bonded to respective ends of the sleeve to form hermetic seals at the opposite ends, the fuse element being disposed entirely within the sleeve and entirely between the collars.

7. A fuse link as claimed in claim 6, in which the annular collars are of glass and the tail wires extend through respective collars into the sleeve.

8. A fuse link as claimed in claim 6, in which the collars are of metal.

9. A fuse link as claimed in claim 8, in which the collars are of a nickel iron alloy having a coefficient of expansion matching that of the glass of the sleeve.

10. A fuse link as claimed in claim 6, in which each collar comprises a solid cylindrical body fitted within a respective sleeve end and formed on opposite sides with spigots fusion bonded to an end of the fuse element and an end of a tail wire respectively.

* * * * *